US008651346B1

(12) United States Patent
Williams

(10) Patent No.: US 8,651,346 B1
(45) Date of Patent: Feb. 18, 2014

(54) WEARABLE BAND INCLUDING ACCESSIBLE MEMORY AND WEARER INFORMATION AND CALL PENDANT

(75) Inventor: Michael James Williams, Brentwood, CA (US)

(73) Assignee: MedID Technologies, Inc., Billings, MT (US)

( * ) Notice: Subject to any disclaimer, the term of this patent is extended or adjusted under 35 U.S.C. 154(b) by 766 days.

(21) Appl. No.: 12/787,575

(22) Filed: May 26, 2010

Related U.S. Application Data

(60) Provisional application No. 61/182,176, filed on May 29, 2009.

(51) Int. Cl.
*A44C 5/00* (2006.01)
*A45F 5/00* (2006.01)

(52) U.S. Cl.
USPC ..... 224/222; 224/219; 224/267

(58) Field of Classification Search
USPC ..... 224/222, 219, 267, 581, 183, 587
See application file for complete search history.

(56) References Cited

U.S. PATENT DOCUMENTS

| | | | | |
|---|---|---|---|---|
| 1,823,814 | A * | 9/1931 | Aiello | 132/301 |
| 2,749,634 | A * | 6/1956 | Billett et al. | 40/633 |
| 3,009,614 | A * | 11/1961 | Humphner | 224/219 |
| 3,078,364 | A * | 2/1963 | Neugebauer | 362/26 |
| 3,157,326 | A * | 11/1964 | Murphy | 224/219 |
| 3,402,808 | A * | 9/1968 | Yannuzzi | 206/232 |
| 3,810,566 | A * | 5/1974 | Adams et al. | 40/709 |
| 3,952,690 | A * | 4/1976 | Rizzo et al. | 116/63 P |
| 4,704,770 | A * | 11/1987 | Minami et al. | 24/431 |
| 5,215,334 | A * | 6/1993 | Presson et al. | 283/76 |
| 5,700,036 | A * | 12/1997 | Smith, III | 283/72 |
| 5,704,067 | A * | 1/1998 | Brady | 2/170 |
| 6,050,605 | A * | 4/2000 | Mikelionis et al. | 283/76 |
| 6,213,619 | B1 * | 4/2001 | Yu | 362/103 |
| 7,455,525 | B2 * | 11/2008 | Rambosek et al. | 439/37 |
| 7,597,250 | B2 * | 10/2009 | Finn | 235/380 |
| 7,632,113 | B2 * | 12/2009 | Finn | 439/131 |
| 7,762,470 | B2 * | 7/2010 | Finn et al. | 235/492 |
| 7,815,334 | B2 * | 10/2010 | Sherman | 362/157 |
| 7,942,293 | B2 * | 5/2011 | Lawrence et al. | 224/218 |
| 7,961,108 | B2 * | 6/2011 | Klein | 340/572.8 |
| 8,125,774 | B2 * | 2/2012 | Kelley et al. | 361/679.31 |
| 2004/0233786 | A1 * | 11/2004 | Ting | 368/2 |
| 2007/0080077 | A1 * | 4/2007 | Thormahlen | 206/6.1 |
| 2007/0194066 | A1 * | 8/2007 | Ishihara et al. | 224/164 |
| 2008/0291744 | A1 * | 11/2008 | Hasvold | 365/185.33 |
| 2009/0040874 | A1 * | 2/2009 | Rooney et al. | 368/10 |

FOREIGN PATENT DOCUMENTS

| | | | | |
|---|---|---|---|---|
| JP | 02005031996 | A * | 2/2005 | G06F 1/16 |

* cited by examiner

*Primary Examiner* — Justin Larson
*Assistant Examiner* — Lester L Vanterpool
(74) *Attorney, Agent, or Firm* — Bey & Cotropia PLLC

(57) ABSTRACT

A band for information storage includes an outer mold for attaching the band to a user's wrist, an external housing within the outer mold that includes a hollow upper portion for receiving a first removable component, wherein the first removable component is engraved with information about the user and/or includes an alarm alert or emergency call button; and an internal housing rotatably attached to the external housing and fitted therein for receiving a second removable component, wherein the second removable component includes a portable memory device.

18 Claims, 21 Drawing Sheets

10

18
14
.25"
12
14
16
18
1"

22
18
16
14
12
5"
JOHN DOE
BLOOD TYPE: O
ALLERGIES: N/A
EMERG. CONT.:
929-500-1234
DOB: 10/19/1978
20
2"
FONT SIZE: 4 points

CONCEPT 2

CONCEPT (4)

X-X

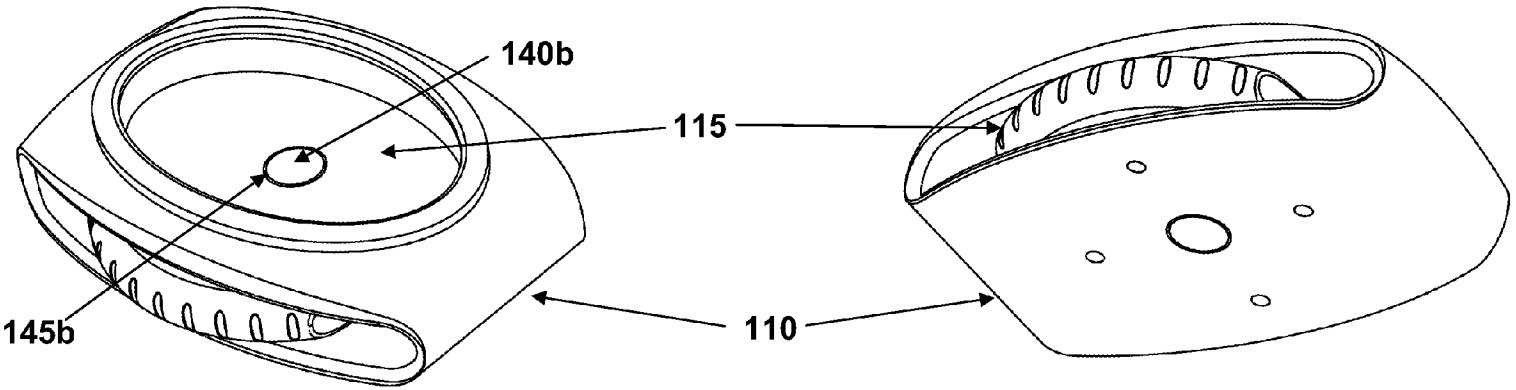
TOP VIEW
FIG. 19a
BOTTOM VIEW
FIG. 19b
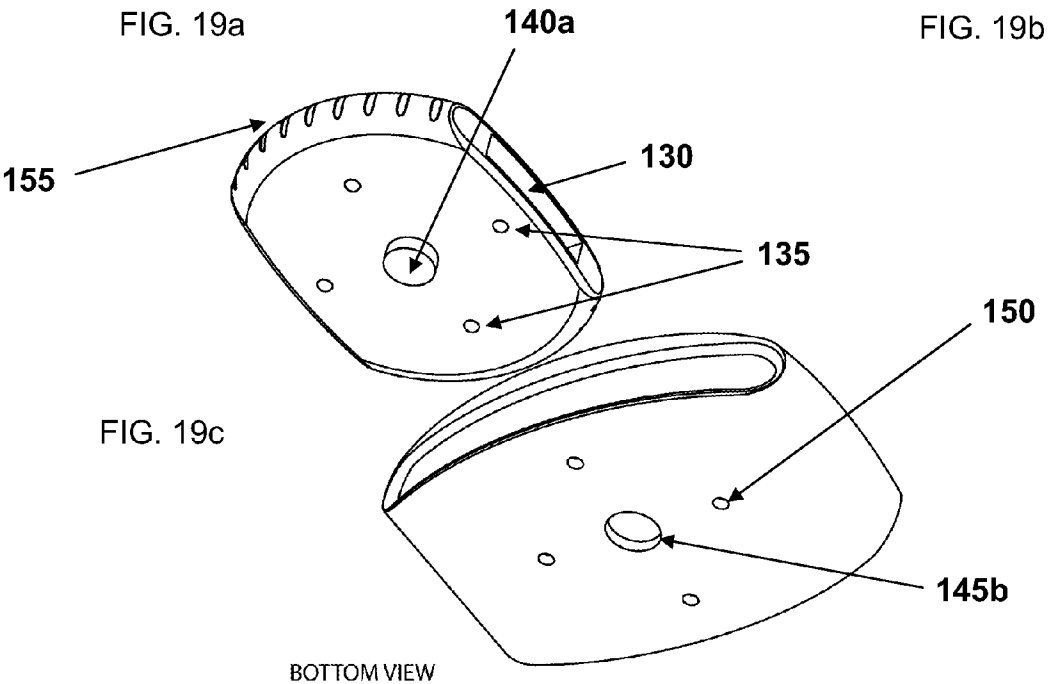
BOTTOM VIEW
FIG. 19c

WEARABLE BAND INCLUDING ACCESSIBLE MEMORY AND WEARER INFORMATION AND CALL PENDANT

CROSS-REFERENCE TO RELATED APPLICATIONS

The present application claims the benefit of priority to U.S. Provisional Patent Application Ser. No. 61/182,176 filed May 29, 2009 the contents of which is incorporated by reference herein in its entirety.

BACKGROUND OF THE INVENTION

1. Field of the Invention

The present invention relates, generally, to the field of electronic data collection, storage, transfer, printing and display on PC or Mac computers while incorporating an engraving identification card or call pendant. More particularly, the invention relates to portable and wearable memory devices that are accessible for adding and retrieving information thereon.

2. Description of Related Art

Current portable memory device products in the marketplace include less than fashionable design, which are big, bulky, non-stylish and non-ergonomic products that can be worn on the wrist. Most feature non adjustable bands and limited ability to fasten securely. The inability to fasten creates a potential problem of loosing important and private medical data and documentation. Also are very susceptible to rust when it has come into contact with water.

Effective and optimal medical treatment and care by medical physicians starts by understanding a patient's medical history. Patients, families and caregivers alike need potentially immediate access to healthcare records in life threatening or critical medical emergencies. Patients generally do not have a simple and yet effective means to manage their own healthcare records while having it on their person. One may have a personal health record but does not wear it and therefore it is left behind or it is not in their pocket when an emergency occurs. In addition, caregivers are unable to locate it when the patient is unconscious or suffers from memory and or cognitive problems which prevent adequate communication to a first responder or medical professional. Limited resources and prior art are available to have such data accessible and on their person while at the same time be able to remove memory device itself without having to remove the band itself.

Personal health records do not provide a comprehensive and therefore accurate history of a patient. This is due in large part to multiple healthcare providers having documentation that generally relates to their own services of care. Over the course of ones lifetime, many will visit many healthcare providers beyond the primary care physician including specialists, in patient hospital visits, pharmacies, therapists and outpatient providers. Medical providers are challenged by obtaining healthcare records often due records being in electronic and or paper which creates difficulty in standardized approach to forwarding necessary documentation to medical professional requesting such data.

There is a need in the art for portable medical band for integrating, linking and managing personal health records and other information.

SUMMARY OF THE INVENTION

In an exemplary embodiment there is described and illustrate a band including information storage. The band includes: an outer mold for attaching the band to a user's wrist; an external housing within the outer mold that includes a hollow upper portion for receiving a first removable component, wherein the first removable component is engraved with information about the user and/or includes an emergency call button or alarm alert mechanism; and an internal housing rotatably attached to the external housing and fitted therein for receiving a second removable component, wherein the second removable component includes a portable memory device.

BRIEF DESCRIPTION OF THE FIGURES

FIGS. 19(*a*)-19(*c*) depict various views of the internal and external housings which are part of the portable memory device.

DETAILED DESCRIPTION OF THE INVENTION

The present invention provides a low profile, adjustable wrist band that contains a removable memory, such as a USB or other memory device or micro-chip. The memory device may be pre-loaded with one or more computer software programs for facilitating the saving, organizing, storage, retrieval and viewing of various types of data. For example, a wearer's medical information could be handled by a particular computer software program developed for this purpose. An additional feature will enable individuals to engrave information, e.g., identification, critical medical, onto a removable engraving card so as to enable first medical responder's to identify and treat the wearer effectively in a medical emergency. The engraved information may then easily be supplemented by more comprehensive information that is available on the memory device which is easily removed from the wrist band and may be read by an appropriately configured reader/processor.

The present invention revolutionizes the way medical information and personal health records are stored and secured, while offering portable method of doing so. Such an invention transcends traditional medical identification jewelry. The present invention offers the ability to combine a person's medical history data that is worn in the form of a fashionable and comfortable band enabling immediate access to critical health records.

Personal health information worn in the way of a band enables first responders, healthcare professionals, caregivers, and family or themselves instant access to otherwise difficult information to obtain or to keep organized.

The computer software programs may be an electronic auto-run software program compatible with Windows or Mac systems. Various view and edit fields within tabs include: Personal Information, Medical History, Health Management Tracker tool or a Health Journal and document Image Manager. The owner has absolute and total control over level of security including password protection, completeness, accuracy, confidentiality, security, backups and availability of all contained information.

The present invention allows individuals to take personal responsibility and control of their health care records.

Unique features of the invention include an internal swivel mechanism allowing ergonomic removal of the USB or other memory device as well as access to engraving card. Removal of micro-chip or engraving card can be accomplished without having to take off the housing. Other unique features include an adjustable band and easy access to internal swivel mechanism while allowing a click in feature that ensures visual inspection of secured USB microchip. Additionally, the housing is waterproof and rust resistant.

Figures 1A, 1B, 1C:
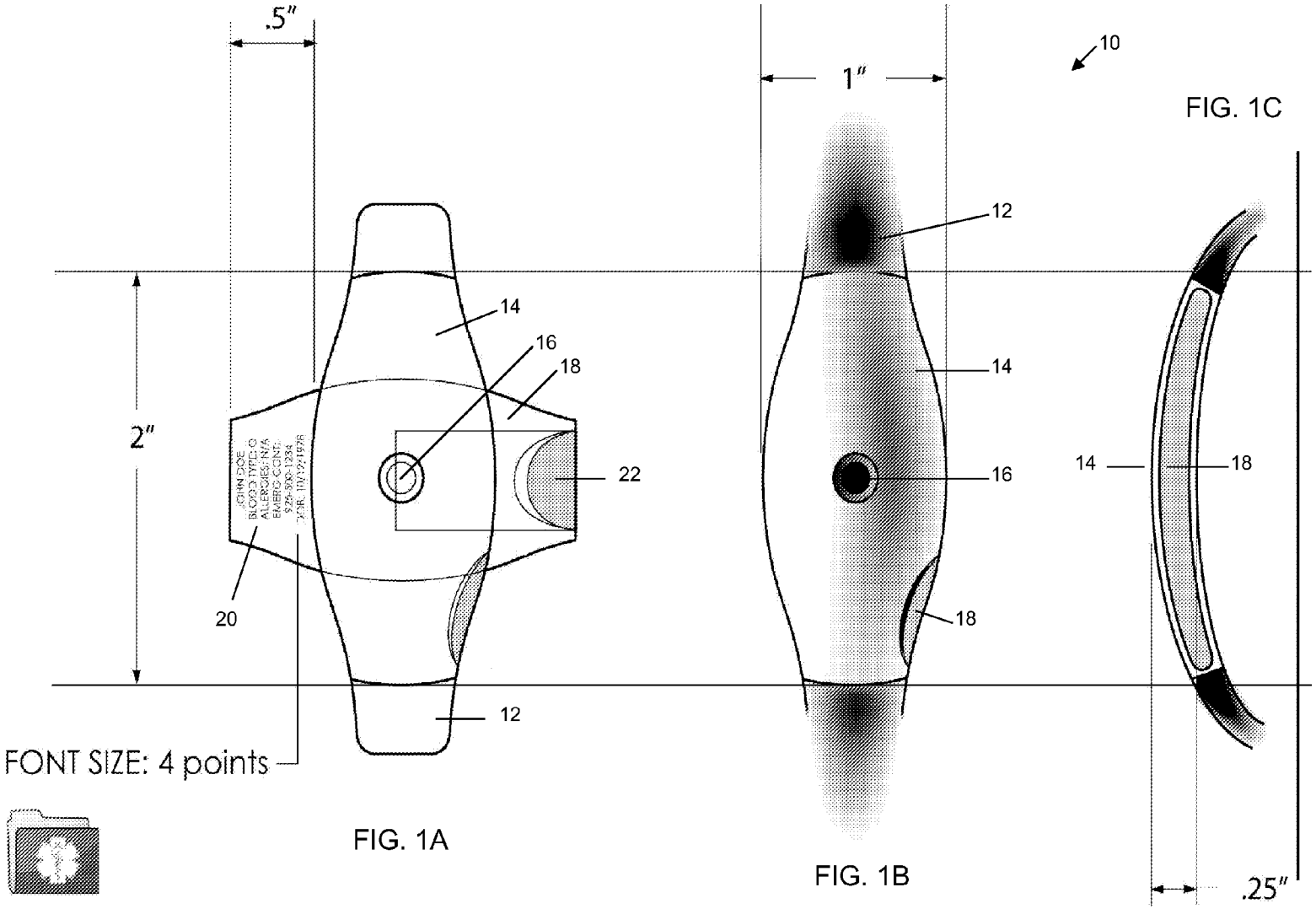
FIG. 1A depicts a top view of the portable memory device showing the internal housing perpendicular to the external housing in the open position. The left side of the internal housing includes the removable engraved card, which includes the medical information of the user, and the right side of the internal housing contains the removable memory chip. This view also shows the circular pivot point located in the center of the external housing which shows the status of the memory chip.
FIG. 1B depicts a top view of the portable memory device with the external housing attached to an adjustable wristband showing the internal housing contained within the external housing in the closed position, with the circular pivot point indicating the status of the memory chip.
FIG. 1C depicts a side view of the portable memory device with the external housing attached to an adjustable wristband showing the internal housing contained within the external housing in the closed position

FIG. 1A shows a portable memory device 10 in accordance with a preferred embodiment of the present invention. The memory device 10 includes an external housing 14 attached to an adjustable wristband 12 with the circular pivot point 16, which shows the status of the memory chip, in the center of the external housing 14 and is the swivel point for the internal housing. The external housing 14 is approximately 2" long in this exemplary embodiment. The internal housing 18 is perpendicular to the external housing 14 in the open position with the left side of the internal housing 18 holding a removable engraved card 20 (0.5" wide with a font size of 4 points in this particular example), which includes user information, such as the medical information of the user (name, blood type, allergies, etc.), and the right side of the internal housing 18 holding a removable memory chip 22, which includes additional user information, such as the user's medical records. The removable engraved card 20 and the memory chip 22 can be removed without needing to remove the entire portal device from the user's arm (or leg).

The internal housing 18 may include various internal notch configurations in order to physically accommodate and secure microchips have different physical configurations and sizes. Additionally, various internal adapters may be included in order to receive different sizes of microchips and then the adapter is fitted into the internal housing to secure the microchip therein.

FIG. 1B shows the memory device 10 with the external housing 14 (1" wide) attached to an adjustable wristband 12 with the circular pivot point 16 in the center of the external housing 14, which indicates the status of the memory chip 22 and is the swivel point for the internal housing. The internal housing 18 is contained within the external housing 14 in the closed position.

FIG. 1C shows the memory device 10 from the side view (0.25" in height) with the external housing 14 attached to the adjustable wristband 12 with the internal housing 18 contained within the external housing 14 in the closed position.

Figure 2:
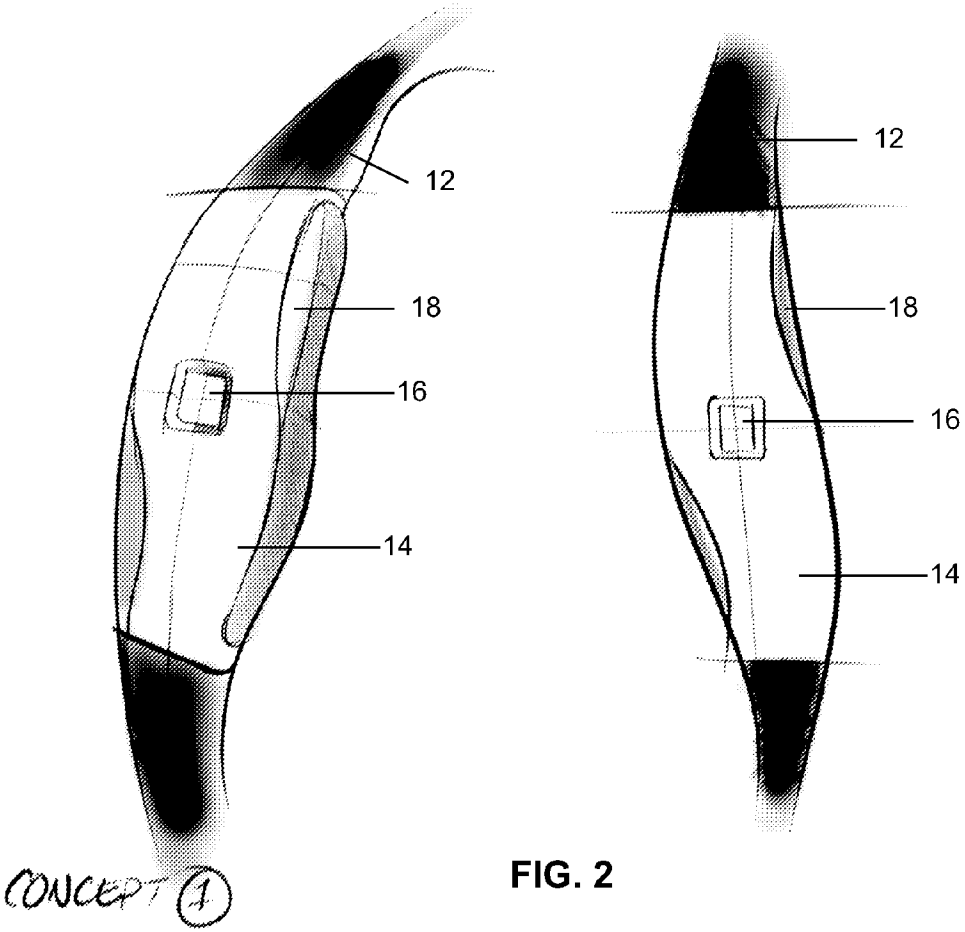
FIG. 2 depicts an angular and top view of the portable memory device with the external housing attached to an adjustable wristband showing the internal housing contained within the external housing in the closed position with the pivot point being a square located in the center of the external housing in accordance with an embodiment of the present invention.

FIG. 2 shows an angular and top view of the portable memory device 10 with the external housing 14 attached to an adjustable wristband 12 showing the internal housing 18 contained within the external housing 14 in the closed position. The figure shows the pivot point 16 as a square in accordance with an alternative embodiment of the present invention.

Figure 3:
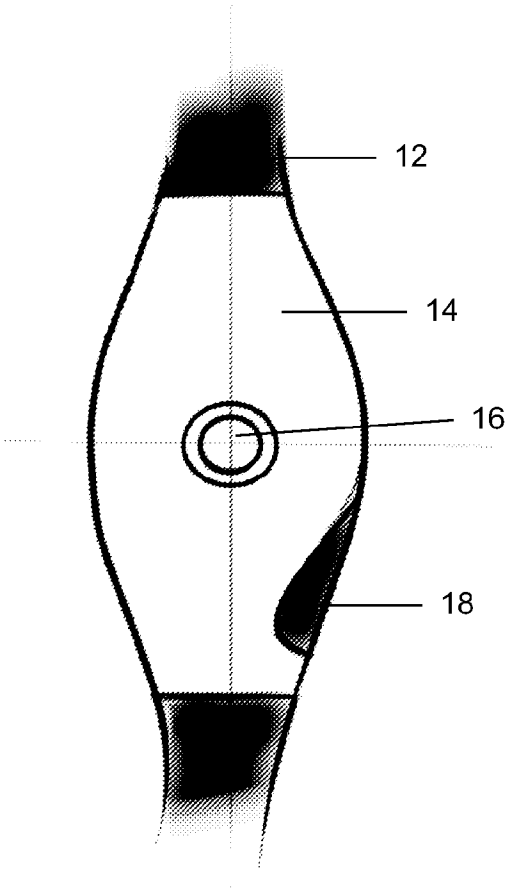
FIG. 3 depicts an angular and top view of the portable memory device with the external housing attached to an adjustable wristband showing the internal housing contained within the external housing in the closed position with the pivot point being a circle located in the center of the external housing in accordance with an embodiment of the present invention.
Figure 3:
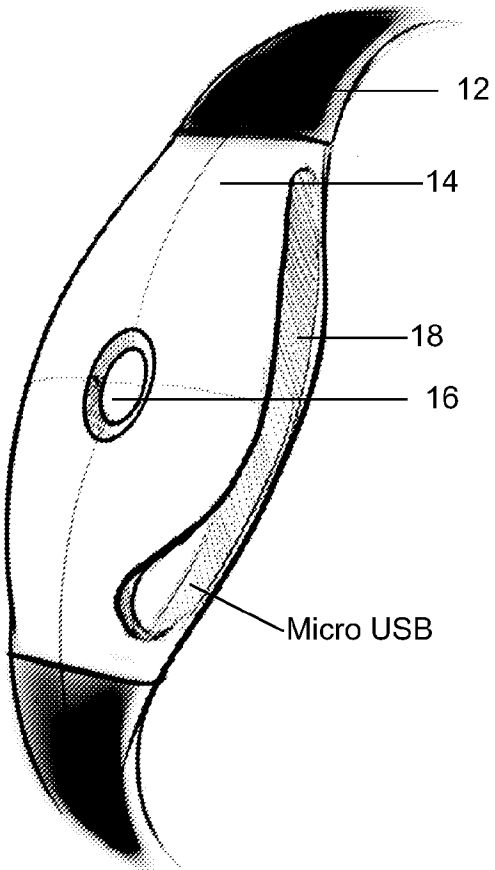

FIG. 3 shows an angular and top view of the portable memory device 10 with the external housing 14 attached to an adjustable wristband 12 showing the internal housing 18 contained within the external housing 14 in the closed position. The figure shows a circular pivot point 16 in accordance with an embodiment of the present invention.

Figure 4:
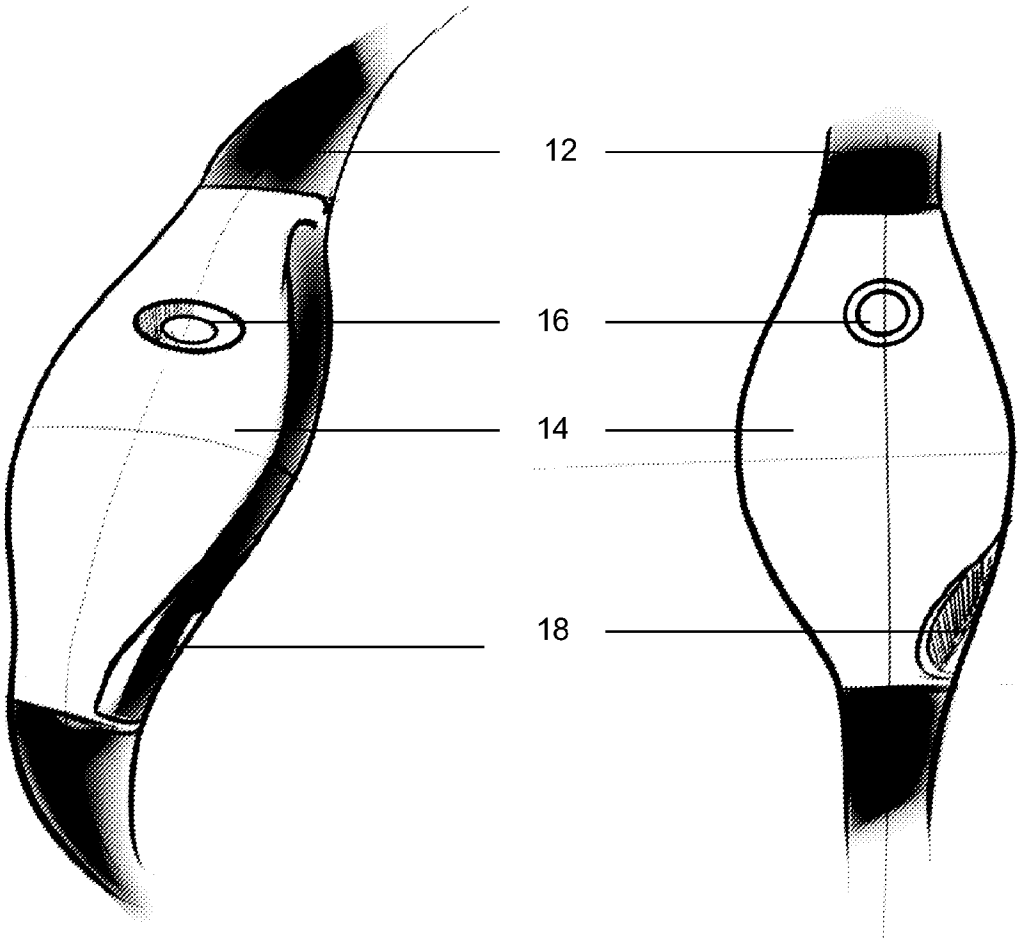
FIG. 4 depicts an angular and top view of the portable memory device with the external housing attached to an adjustable wristband showing the internal housing contained within the external housing in the closed position with the pivot point being a circle located north of center of the external housing in accordance with an embodiment of the present invention.

FIG. 4 shows an angular and top view of the portable memory device 10 with the external housing 14 attached to an adjustable wristband 12 showing the internal housing 18 contained within the external housing 14 in the closed position. The figure shows a circular pivot point 16 located north of center of the external housing 14 in accordance with an embodiment of the present invention.

Figure 5:
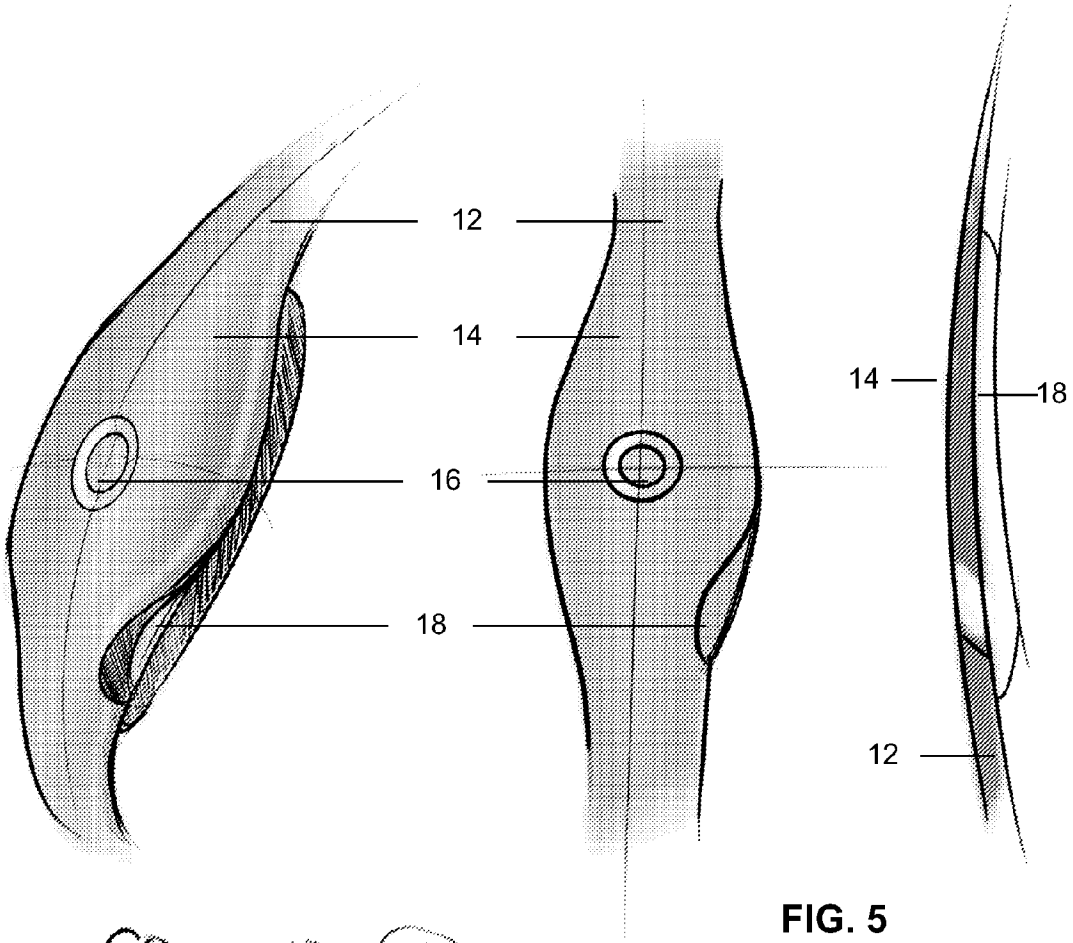
FIG. 5 depicts an angular, top, and side view of the portable memory device with the external housing attached to an adjustable wristband showing the internal housing contained within the external housing in the closed position with the pivot point being a circle located in the center of the external housing in accordance with an embodiment of the present invention.

FIG. 5 depicts an angular, top, and side view of the portable memory device 10 with the external housing 14 attached to an adjustable wristband 12 with the internal housing 18 contained within the external housing 14 in the closed position. The circular pivot point 16 located in the center of the external housing 14 shows the user that the memory chip 22 (not shown in this Figure) is locked in place within the internal housing 18.

Figure 6:
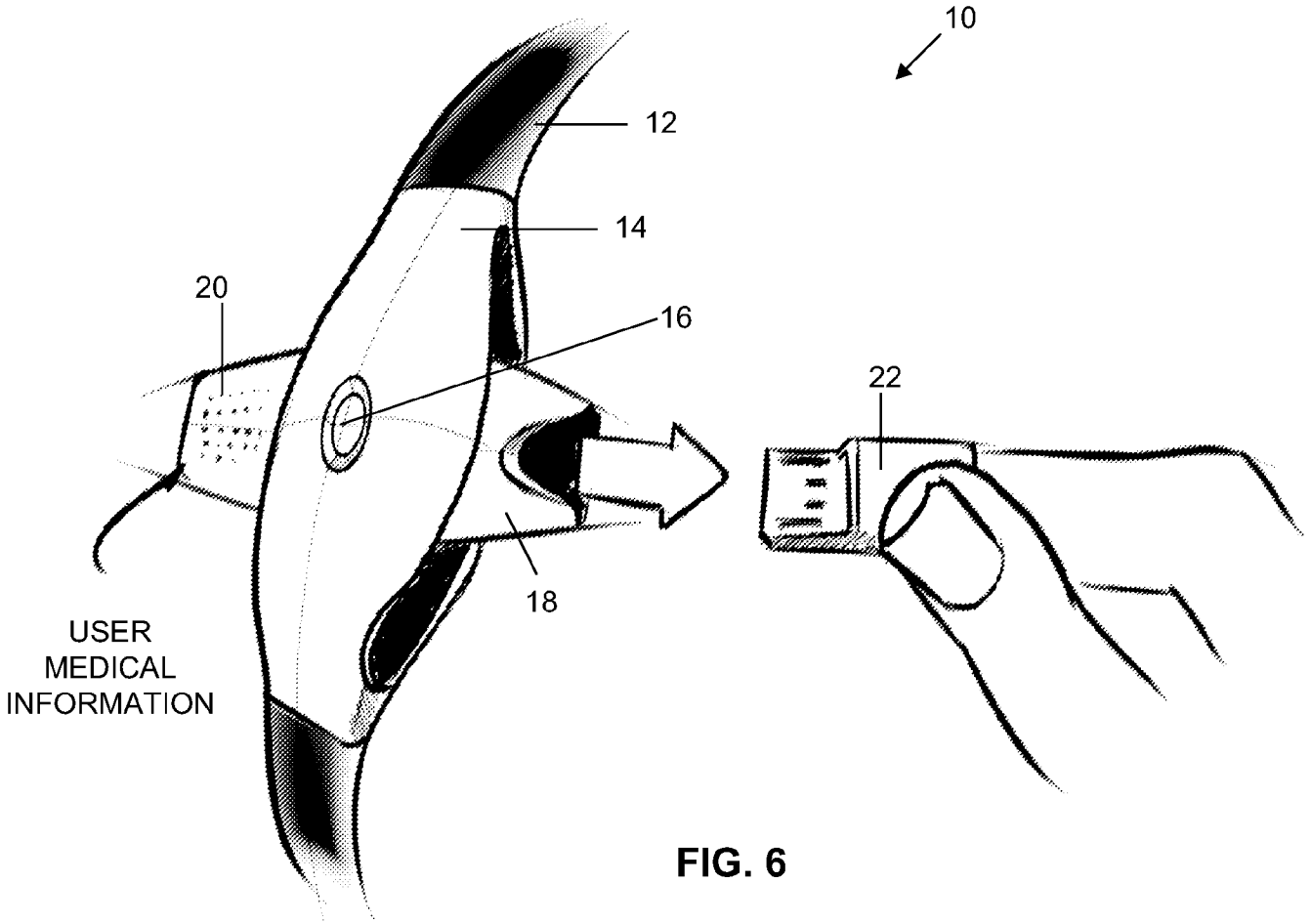
FIG. 6 depicts the portable memory device with the internal housing perpendicular to the external housing, in the open position, showing the engraved medical information of the user and the ability to easily remove the memory chip from the internal housing.

FIG. 6 shows the portable memory device 10 with the external housing 14 attached to an adjustable wristband 12. The internal housing 18 is perpendicular to the external housing 14 in the open position. The removable engraved card 20, which includes the medical information of the user (name, blood type, allergies, etc.), is visible on the left side of the internal housing 18. The right side of the internal housing 18 shows the location of the removable memory chip 22 and the ease with which the memory chip 22 can be removed and handled. The removable engraved card 20 and the memory chip 22 can be removed without needing to remove the entire portal device from the user's arm (or leg).

Figures 7A, 7B, 7C:
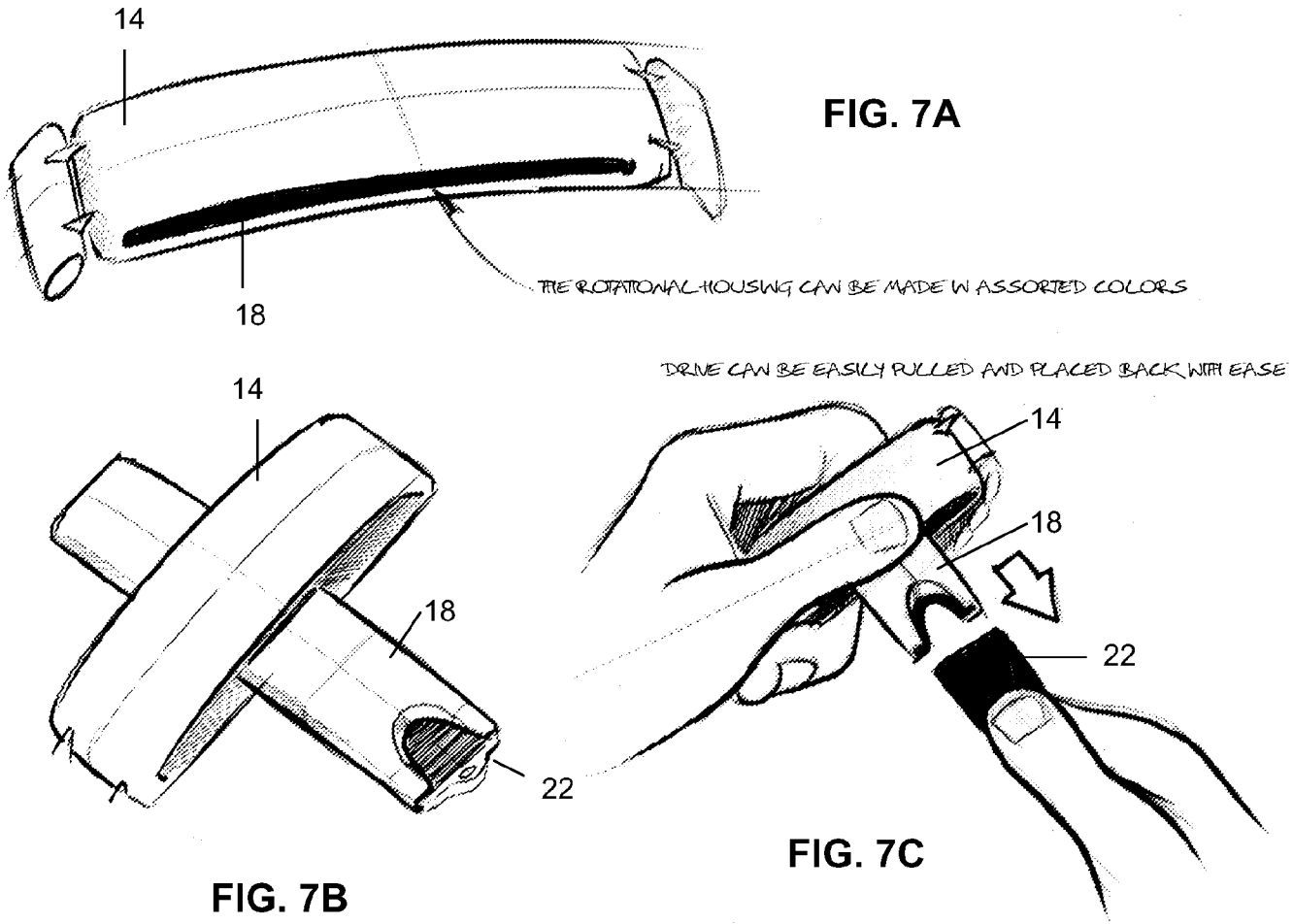
FIG. 7A depicts the external housing with the internal housing contained therein in the closed position.
FIG. 7B depicts the internal housing perpendicular to the external housing, in the open position, with the removable memory chip held on the right side of the internal housing.
FIG. 7C depicts the internal housing perpendicular to the external housing and showing the easy removal of the memory chip from the internal housing.

FIG. 7A shows the external housing 14 of the portable memory device 10 with the internal housing 18 contained therein in the closed position. The internal housing can be made in an assortment of colors to personalize the portable memory device to its user.

FIG. 7B shows the capability of the internal housing 18 to pivot and become perpendicular to the external housing 14 with the memory chip 22 located on the right side of the internal housing 18.

FIG. 7C shows the ability to easily remove the memory chip 22 from the internal housing 18 when it has been opened at a 90 degree angle from the external housing 14.

Figure 8:
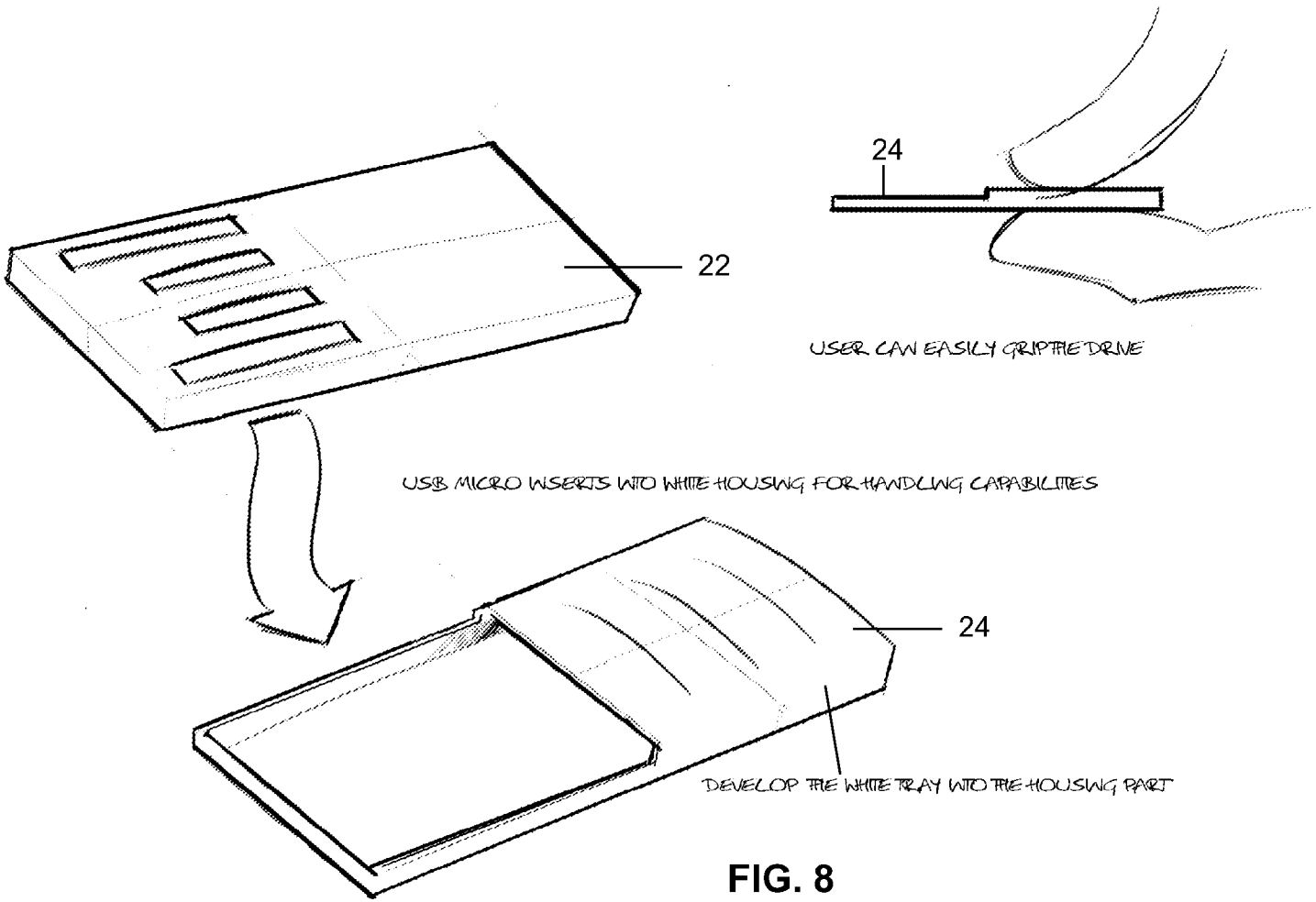
FIG. 8 depicts the angular view of the memory chip, together with the side and angular view of the holding tray used to cradle the removable memory chip.

FIG. 8 shows the memory chip 22 and the holding tray 24 that cradles, protects, and supports the memory chip 22 when the memory chip 22 is inserted and removed from the internal housing 18. The memory chip 22 has a flat, covered surface on the right side of the chip which allows for the handling of the memory chip 22 should the holding tray 24 not include the top housing portion in accordance with an embodiment of the present invention.

Figure 9:
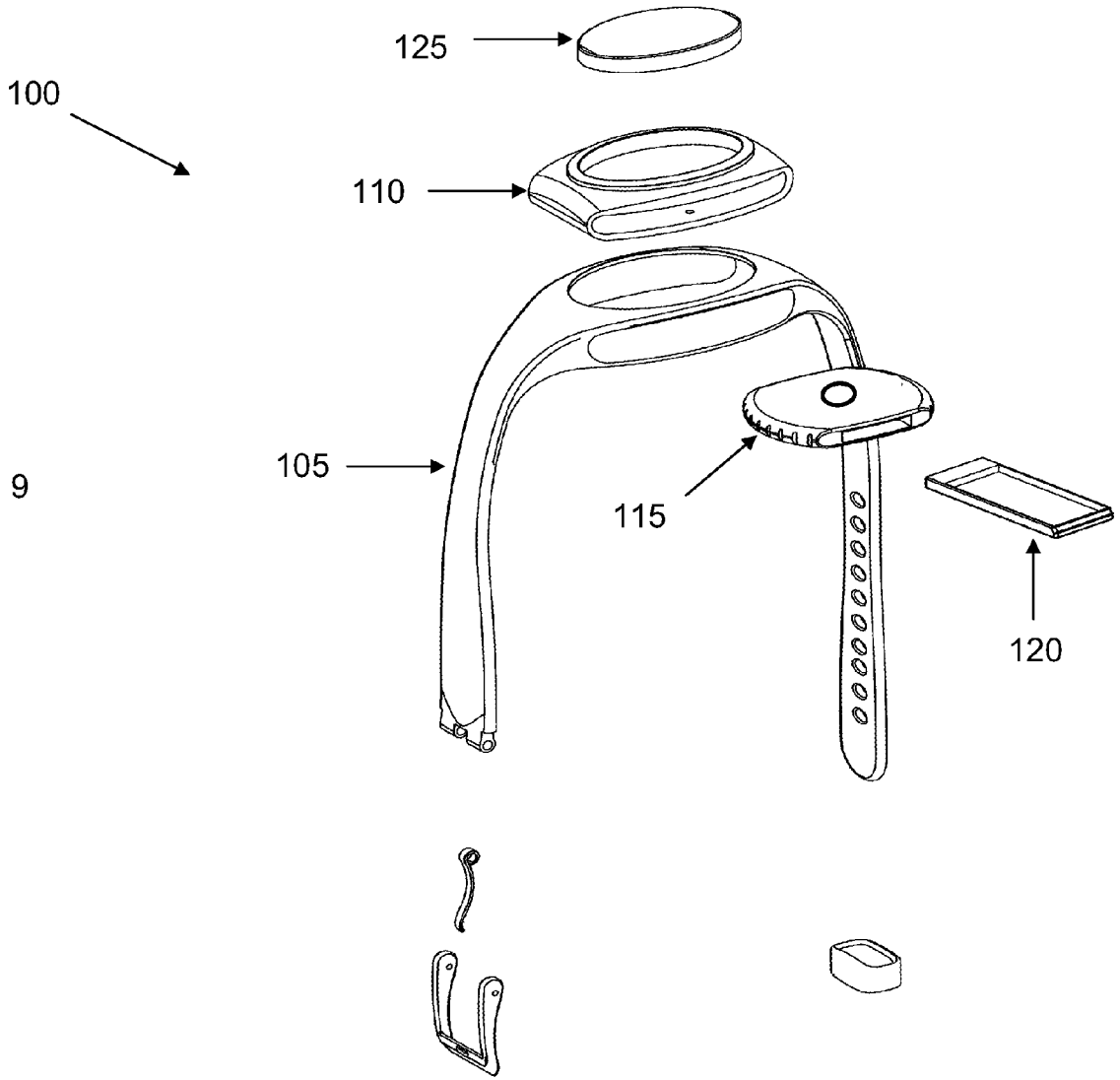
FIG. 9 depicts an exploded view of a portable memory device.

Referring to FIG. 9, an exploded view of a portable memory device 100 in accordance with an alternative embodiment includes: an over mold 105; an external housing 110; an internal housing 115; a first a removable Universal Serial Bus (USB) or other memory component 120; and a second removable component 125.

Figure 17:
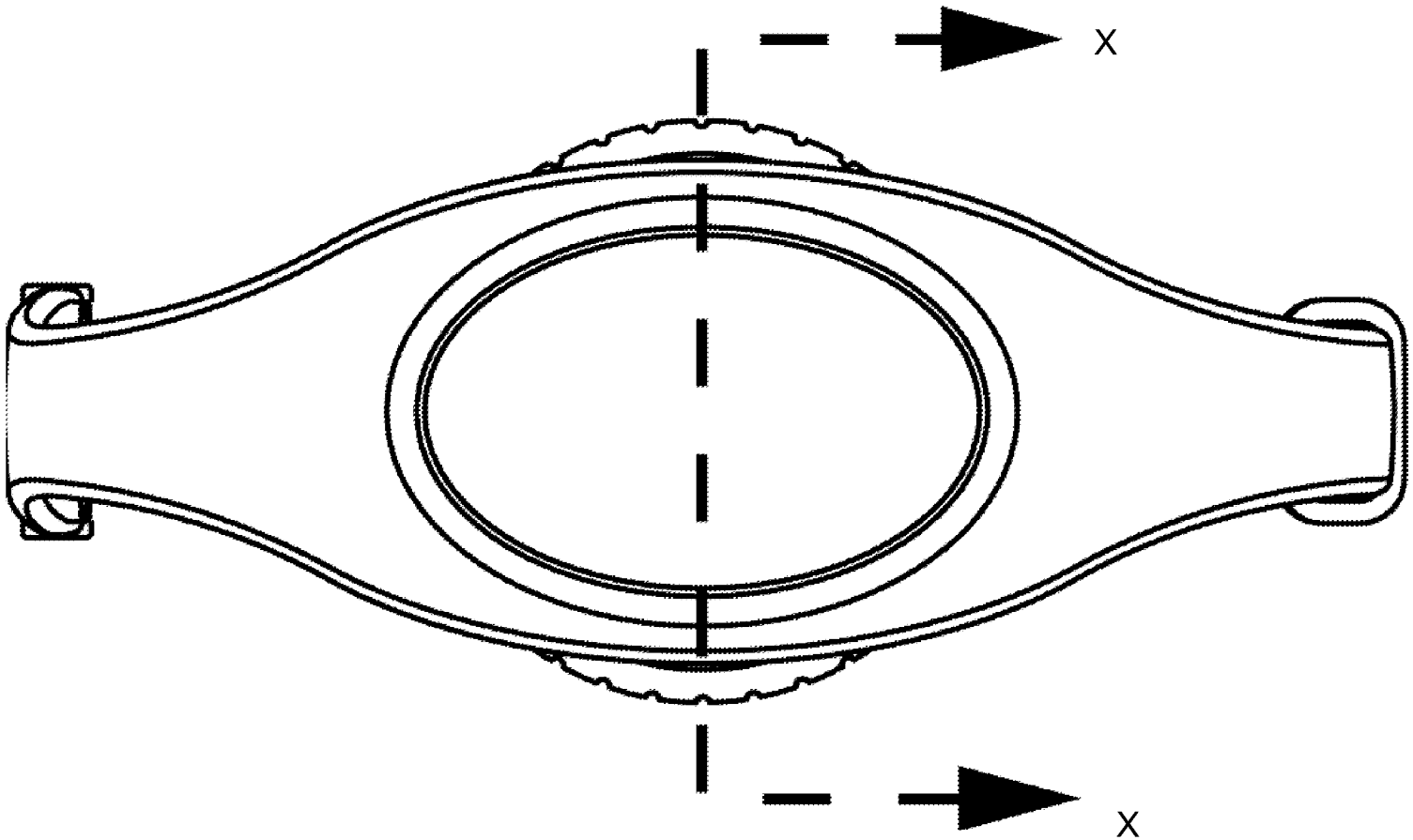
FIG. 17 depicts a top view of a portable memory device.
Figure 18:
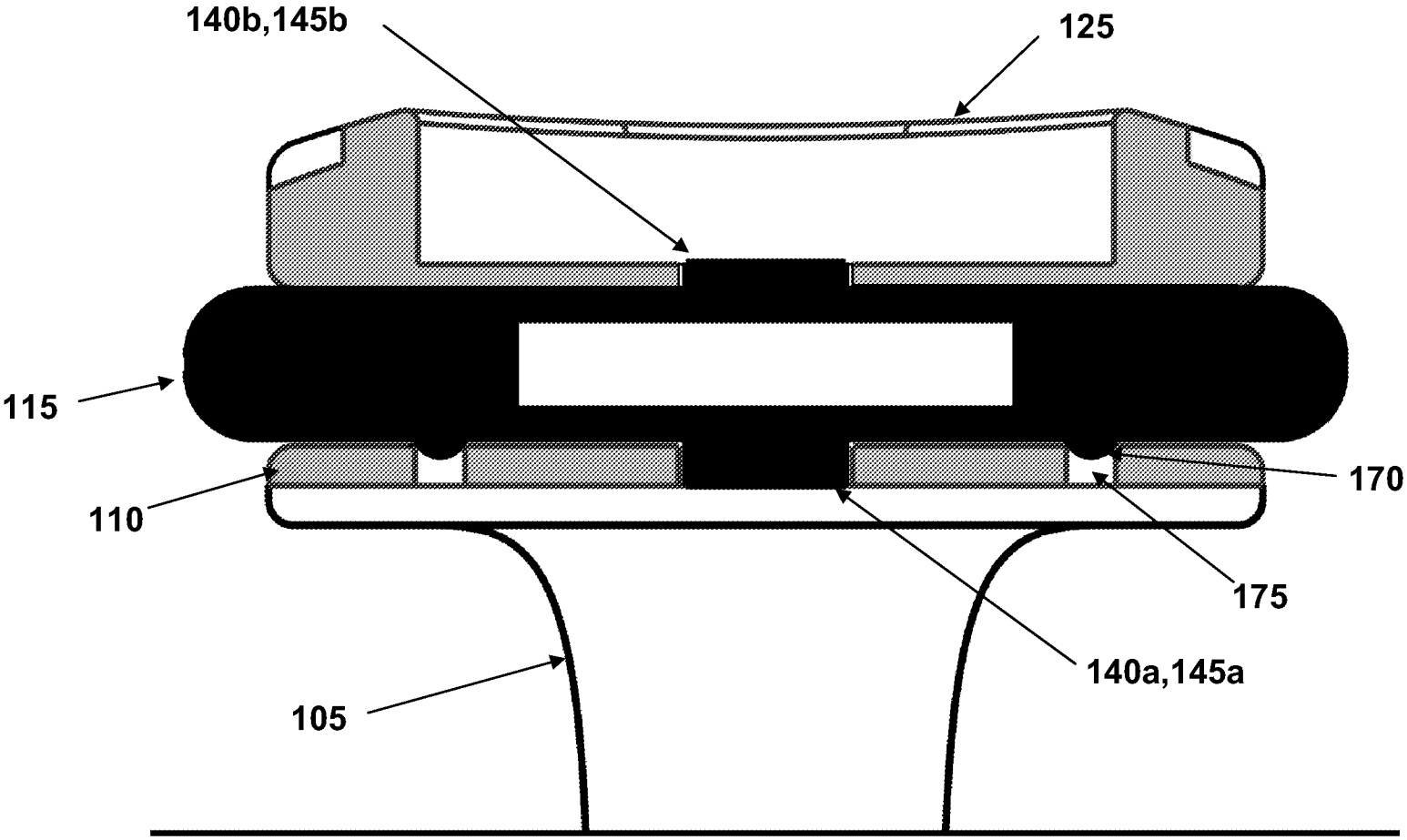
FIG. 18 depicts a cross-sectional view of a portable memory device in accordance with FIG. 17.

Further to FIG. 9, the external housing 110 is formed as part of the over mold 105 which includes the band and band clasps (as shown) that form the bracelet. The second removable component 125 fits into a hollowed out top portion of the external housing in a press fit and is configured so as to be easily removed and inserted by popping-in and out. The internal housing 115 fits rotatably within the external housing 110 and the internal housing is intended to hold and provide removable access to the first USB memory component 120 within slot 130. This USB component includes a USB tray that may hold a USB memory component (See FIGS. 13*a* and 13*b*). Details of the internal housing 115 and external housing 110 are shown in FIGS. 19*a*-19*c*. As shown, the internal housing 115 includes four magnets (or nipples per FIG. 18) 135 and two pivot points 140*a*, 140*b*, e.g., dowels, that fit into respective receiving portions 145*a*, 145*b* on the bottom and top inner faces of the external housing (See FIG. 18). Further, the bottom of the external housing 110 includes metallic rods (or dimples per FIG. 18) 150 therethrough in positions corresponding to the positions of the magnets (or nipples per FIG. 18) 135 on the bottom face of the internal housing 115. This combination of magnets (or dimples and nipples per FIG. 18) and pivot facilitate 90 degree rotation of the internal housing between positions wherein the USB component is accessible for removal and positions wherein the USB component is entirely hidden within the external housing. The internal housing includes ergonomic threads 155 on alternating portions of the outer edge of the inner housing in order to facilitate easier rotation of the inner housing by the user (e.g., wearer or emergency personnel) to access the USB component. Further still, FIGS. 17 and 18 provide a top view of the portable memory device 100 and corresponding cross-sectional view detailing the fit of the various components when the first removable USB memory component is not accessible.

Alternative to the magnetic pivot structure described above, FIG. 18 illustrates a nipple and dimple mechanical pivot control mechanism in place thereof which is combined with the dowel structure. More particularly, in FIG. 18, nipples 170 on the external face (or faces) of the internal housing 115 fit into dimples 175 of the internal faces of the external housing 110 to facilitate the various rotatable positions of the internal housing. While FIG. 18 only shows nipples and dimples on the bottom of the configuration, it is contemplated that the configuration may be duplicated on the top of the configuration or may only be found on the top of the configuration.

Figure 10:
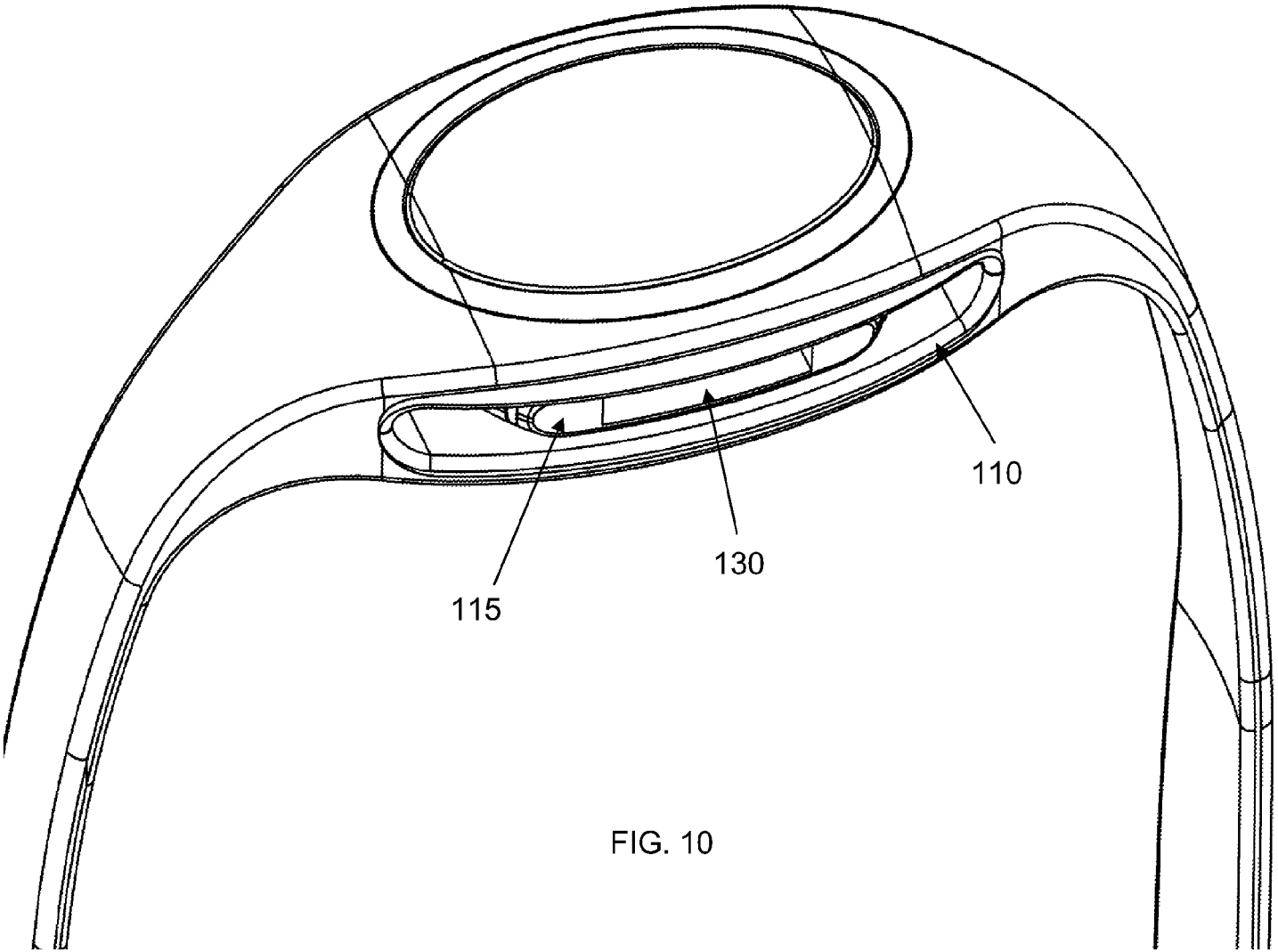
FIG. 10 depicts a configuration of a portable memory device wherein a USB memory may be removed or inserted.
Figure 11:
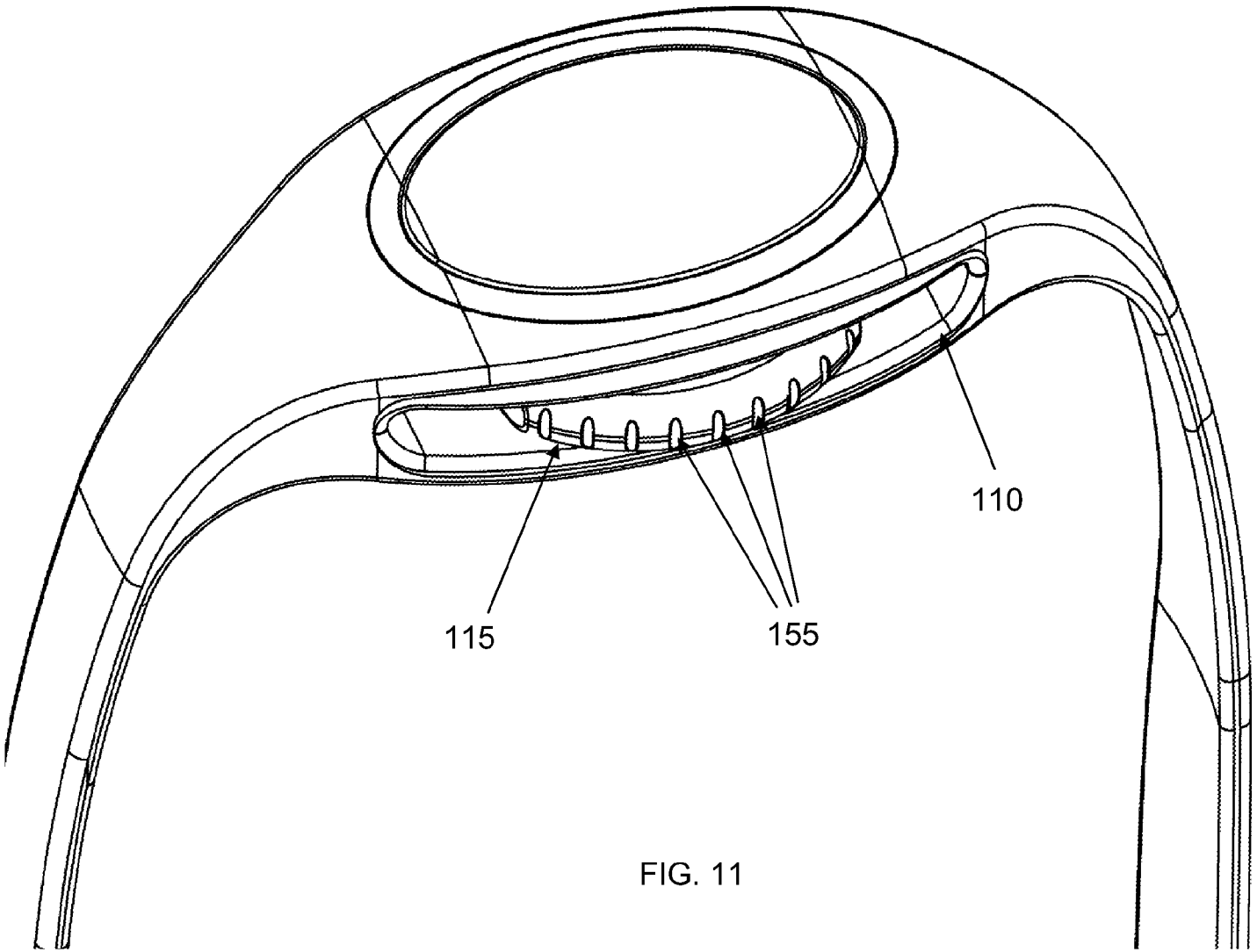
FIG. 11 depicts a configuration of a portable memory device wherein a USB memory may not be removed or inserted.
Figure 12:
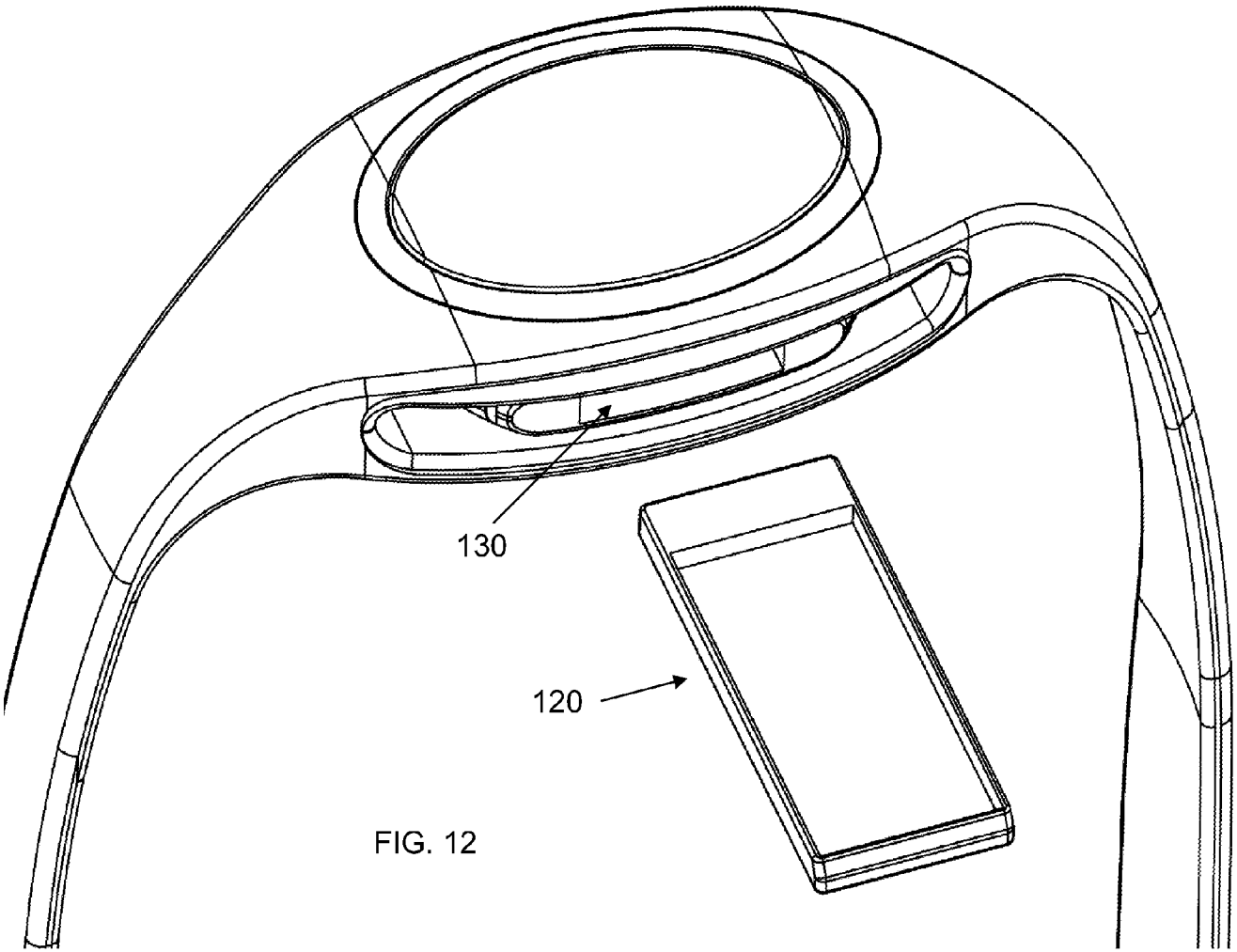
FIG. 12 depicts a configuration of a portable memory device wherein a USB memory may be removed or inserted and the USB tray is shown.
Figure 13A:
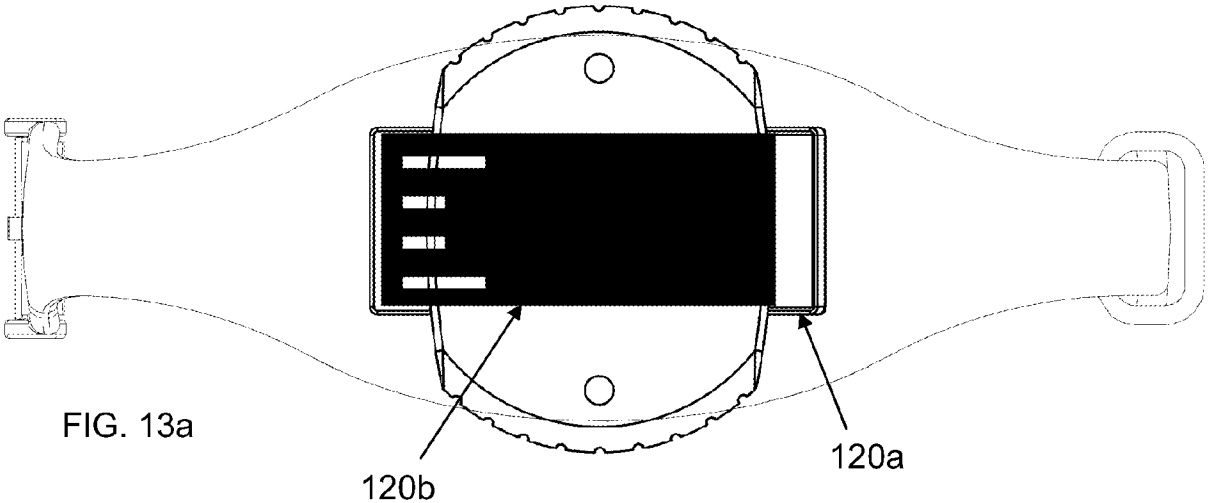
FIGS. 13*a* and 13*b* depict internal configurations of a portable memory device wherein a USB memory is secured within the device and is available for removal.
Figure 13B:
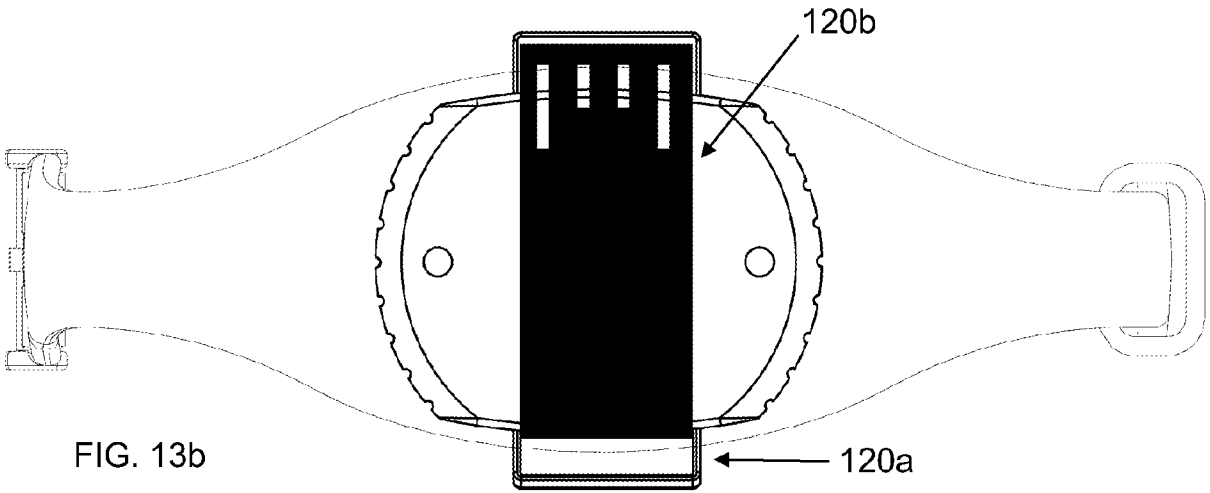
Figure 14:
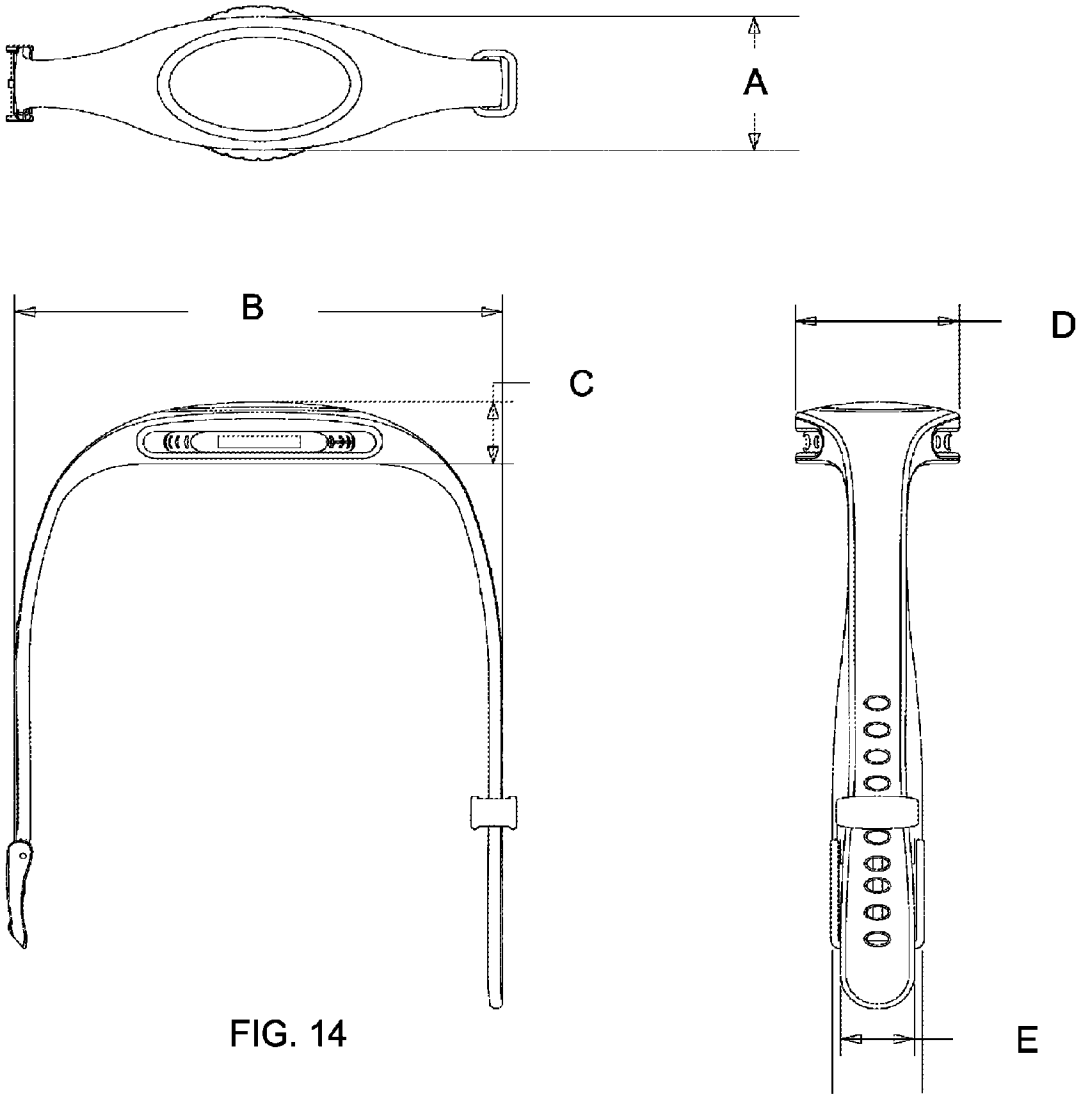
FIG. 14 refers to various dimensions of a portable memory device.
Figure 15:
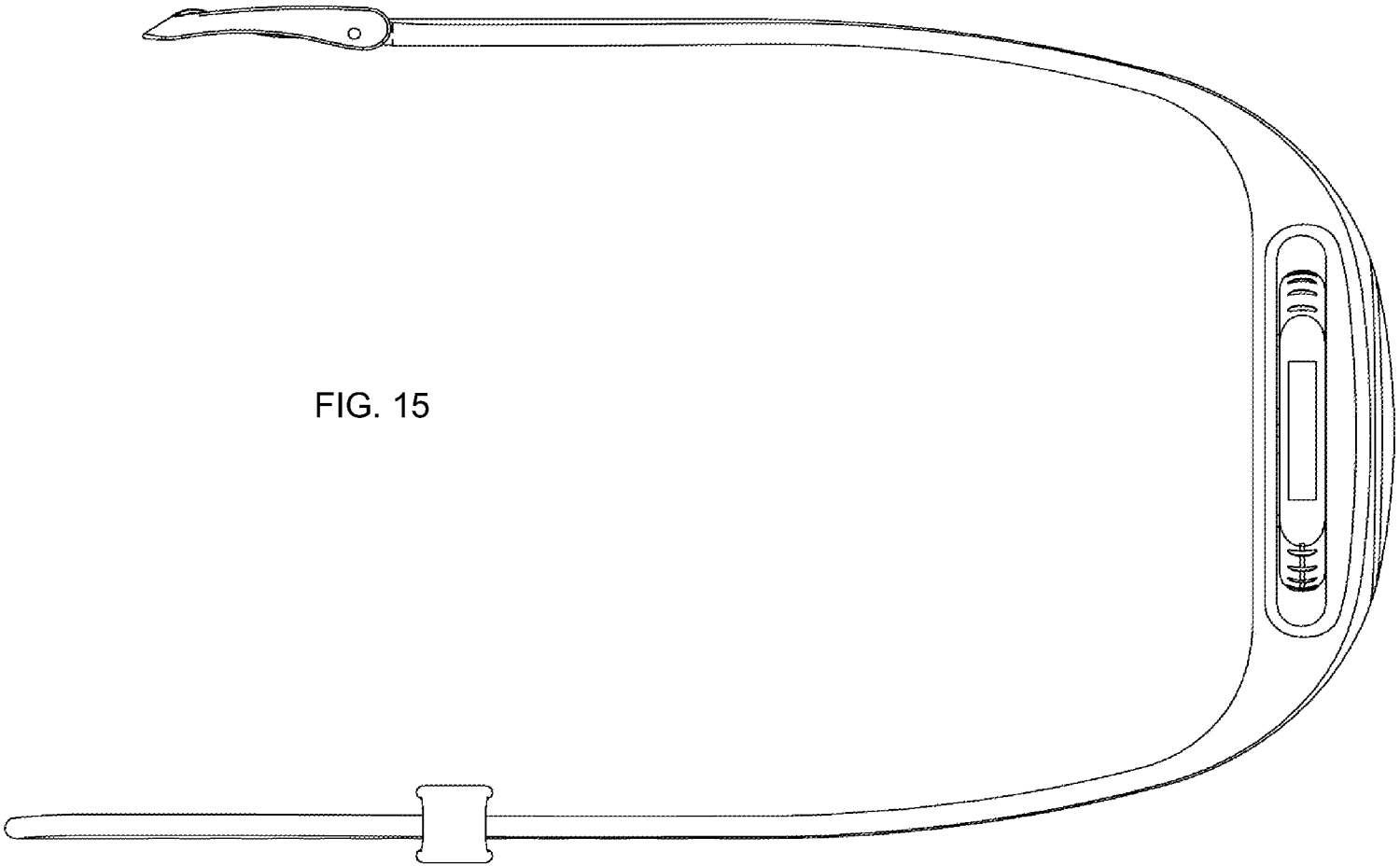
FIG. 15 depicts a side view of a portable memory device wherein a USB memory may be removed or inserted.
Figure 16:
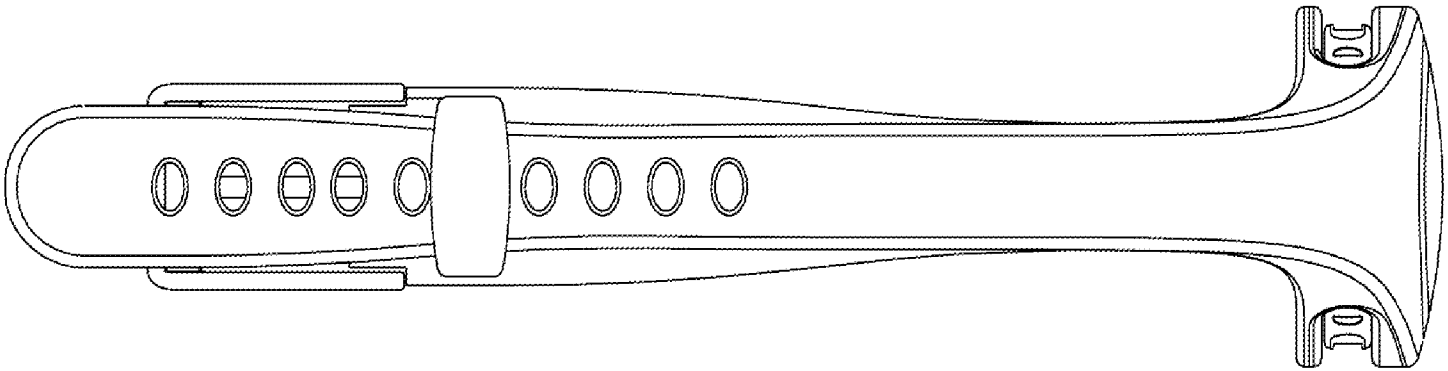
FIG. 16 depicts an alternate side view of a portable memory device.

FIG. 10 illustrate the portable memory device 100 when the first USB memory component 120 is accessible since the internal housing 115 is rotated such that the USB component may be removed from slot 130. In comparison, FIG. 11 illustrates the portable memory device 100 when the first USB memory component 120 is not accessible since the internal housing 115 is rotated such that the USB component is fully hidden within the internal housing. Instead, the ergonomic threads 155 face the open sides of the external housing 110. FIG. 12 shows the first USB memory component 120 removed from the slot 130. FIGS. 13*a* and 13*b* show the internal configuration of the first USB memory component 120 when it is not accessible for removal (FIG. 13*a*) and when it is not accessible for removal (FIG. 13*b*). This USB component includes a USB tray 120*a* that may hold a USB memory component 120*b*. In an exemplary configuration, the dimensions of the portable memory device may be approximately as follows as indicated in FIG. 14: A=2.54 cm; B=7.56 cm; C=1.17 cm; D=2.54 cm; and E=1.14 cm. One skilled in the art recognizes that these dimensions are merely exemplary. Additional views of the portable memory device are shown in FIGS. 15 and 16.

Figures 20A, 20B, 20C:
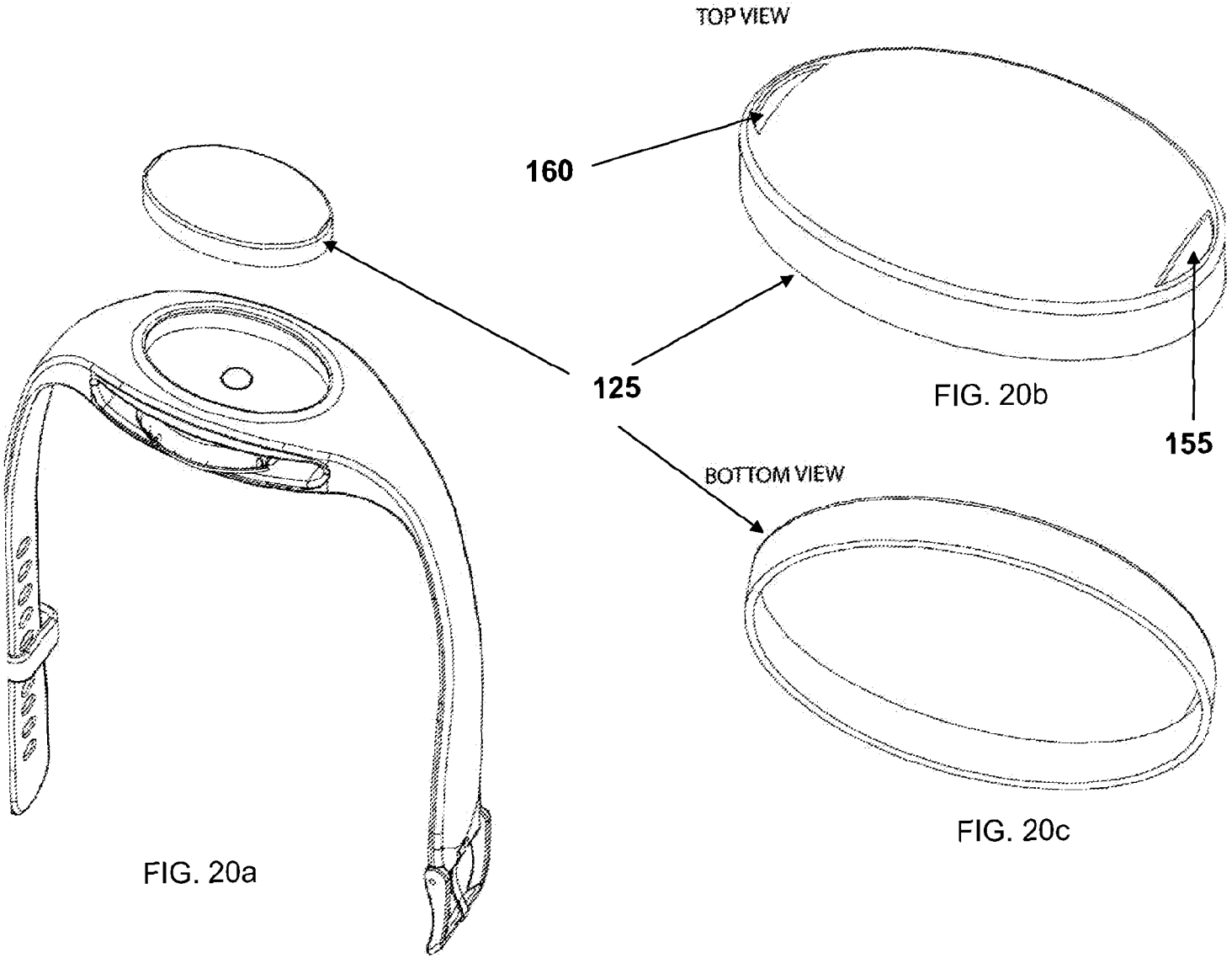
FIGS. 20(*a*)-20(*c*) depict various views of a removable component which is part of the portable memory device.
Figure 21:
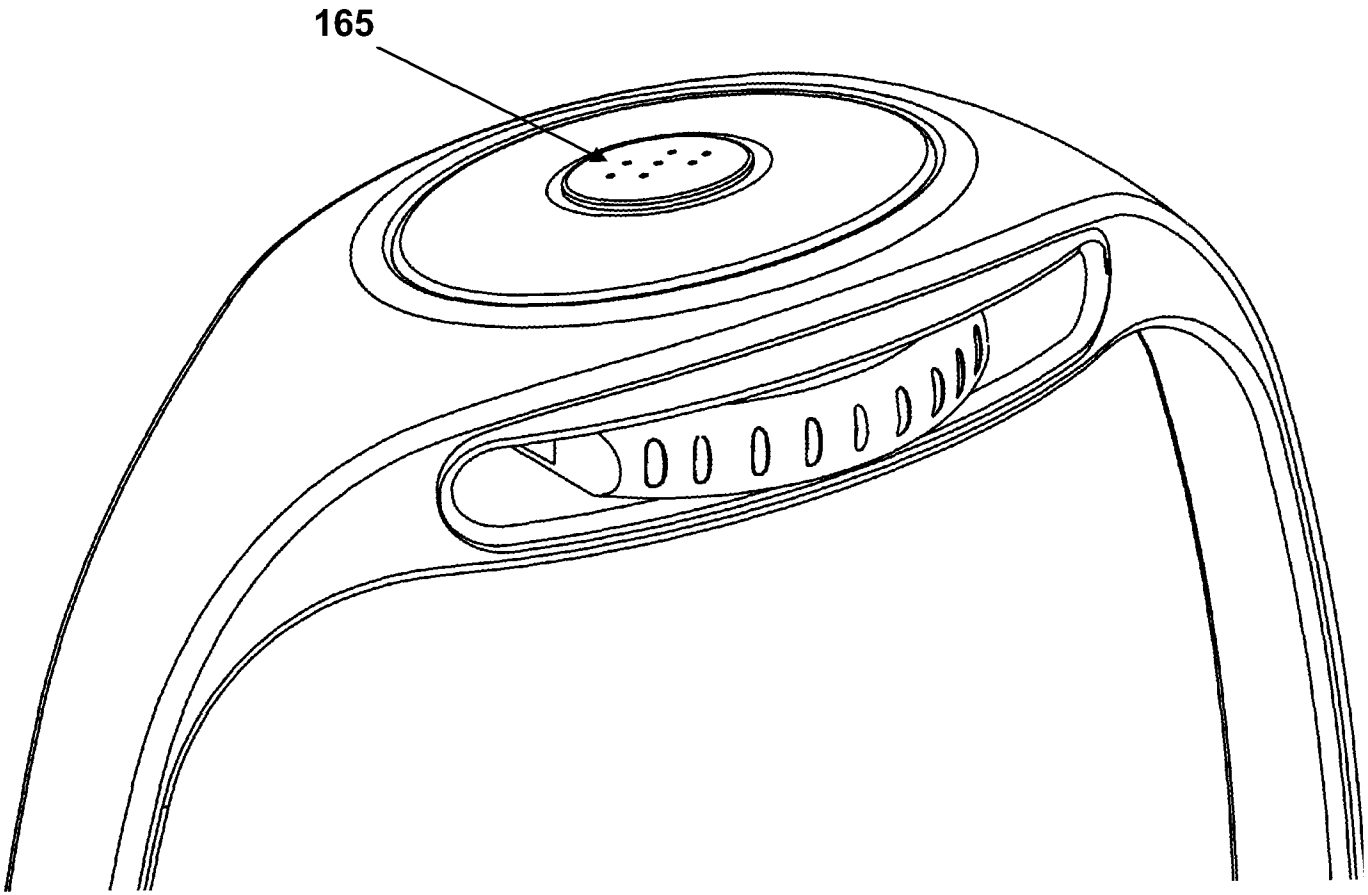
FIG. 21 depicts a view of the portable memory device wherein the removable component includes a call button.

Referring to FIGS. 20*a*-20*c*, details of the second removable component 125 are illustrated. A particular exemplary configuration includes crescent shaped cut-outs or indentions 160 at one or both ends of the second removable component 125 in order to facilitate removal from the press fit in the external housing 110. The second removable component 125 may be formed of an engravable material, including but not limited to metals, glass, plastics and the like that can be engraved/customized to include identification information that is unique to the user (e.g., wearer). This is information that would traditionally be on a medical identification bracelet, e.g., name, allergies, medical conditions, etc. that would be helpful to an emergency responder. The removable component may be in the form of an electronic chip or pendant, such as an emergency call button pendant that traditionally hangs around the neck of the wearer. FIG. 20 illustrates the configuration wherein the second removable component 125 includes an emergency call button or alarm alert mechanism 165. Such emergency call button technology is known to those skilled in the art; see for example, the LifeFone and LifeAlert systems.

By way of non-limiting example, the over mold is silicone or a comparable material(s). The inner housing, outer housing and USB tray are ABS plastic or a comparable material. Additionally, the bottom, inner face of the outer housing which faces the bottom outer face of the internal housing includes areas of metal that correspond to the locations of the magnets on the internal housing as described herein. The USB tray can include any number of standard USB or other memory components which are known to those skilled in the art such as secure digital ("SD") chip, wireless chip memory, bar code, RF chip or any other means of storing electronic data or software.

The healthcare industry will find the present invention to be truly unique and of great importance to immediate optimal care and treatment while encouraging and motivating patients to take control over their Personal Health Records. Individuals with critical pre-existing conditions will find great comfort in knowing they have empowered those that will help them in medical emergencies.

Individuals whom participate in extreme sports or hobbies such as motorcycles, racing, skateboarding, hang gliding, diving, flying or kayaking etc. would also protect themselves by having their Personal Health Records available. And in the case of a minor, the band could be worn by a parent or guardian and include Personal Health Record information for the minor. Individuals within the security, military or the surveillance industry will also benefit from the present invention. As would those in professions that involve some level of danger. Additionally, private label companies featuring promotional goods, the technology and electronics industry in addition to the field education and business may find the invention to be of use.

The invention claimed is:

1. A band including information storage comprising:
an outer mold for attaching the band to a user;
a first removable component;
an external housing within the outer mold that includes a hollow upper portion for receiving the first removable component;
a second removable component; and
an internal housing rotatably attached to the external housing and fitted therein for receiving the second removable component, wherein the first removable component includes an opening in at least one end thereof for facilitating removal of the first removable component from the external housing.

2. The band according to claim 1, wherein the internal housing includes at least two magnets on a first surface thereof and the external housing includes at least two metallic portions on an inner surface thereof, wherein the first surface and the inner surface face each other and the at least two magnets are attracted to the at least two metallic portions to hold the internal housing in predetermined positions.

3. The band according to claim 2, wherein the first surface of the internal housing includes a dowel protruding therefrom and the external housing includes a corresponding hole on the inner surface thereof to allow the internal housing to pivot around the dowel.

4. The band according to claim 1, wherein the internal housing includes a slot therein for receiving the second removable component and further wherein the external housing has an opening on at least one side such that in at least a first position of the rotatable internal housing, the slot and the opening align to facilitate removal of the second removable component.

5. The band according to claim 1, wherein the internal housing includes threads on portions thereof to facilitate rotation of the internal housing by a user.

6. The band according to claim 2, wherein the predetermined positions of the internal housing include a first position wherein the second removable component is accessible for removal and a second position wherein the second removable component is not accessible for removal.

7. The band according to claim 1, wherein the first removable component includes an emergency call button or alarm alert mechanism.

8. The band according to claim 1, wherein the first removable component is formed of an engravable material for engraving thereon information about a wearer of the band.

9. The band according to claim 1, wherein the second removable component includes a tray capable of storing at least one of a Universal Serial Bus (USB) memory, SD chip, wireless chip memory, bar code, or RF chip.

10. A band including information storage comprising:
an outer mold for attaching the band to a user;
a first removable component;
an external housing within the outer mold that includes a hollow upper portion for receiving the first removable component;
a second removable component; and
an internal housing rotatable attached to the external housing and fitted therein for receiving the second removable component, wherein at least one external face of the internal housing includes at least two nipples and an internal face of the external housing that is adjacent to the at least one external face of the internal housing includes at least two dimples for engaging the at least two nipples to hold the internal housing in a predetermined position.

11. A band including information storage comprising:
an outer mold for attaching the band to a user;
a first removable component;
an external housing within the outer mold that includes a hollow upper portion for receiving the first removable component, wherein the first removable component is engraved with information about the user;
a second removable component; and
an internal housing rotatably attached to the external housing and fitted therein for receiving the second removable component, wherein the second removable component includes a portable memory device, wherein the first removable component includes an opening in at least one end thereof for facilitating removal of the first removable component from the external housing.

12. The band according to claim 11, wherein the internal housing includes at least two magnets on a first surface thereof and the external housing includes at least two metallic portions on an inner surface thereof, wherein the first surface and the inner surface face each other and the at least two magnets are attracted to the at least two metallic portions to hold the internal housing in predetermined positions.

13. The band according to claim 12, wherein the first surface of the internal housing includes a dowel protruding therefrom and the external housing includes a corresponding hole on the inner surface thereof to allow the internal housing to pivot around the dowel.

14. The band according to claim 11, wherein the internal housing includes a slot therein for receiving the second removable component and further wherein the external housing has an opening on at least one side such that in at least a first position of the rotatable internal housing, the slot and the opening align to facilitate removal of the second removable component.

15. The band according to claim 11, wherein the internal housing includes threads on portions thereof to facilitate rotation of the internal housing by a user.

16. The band according to claim 11, wherein the predetermined positions of the internal housing include a first position wherein the second removable component is accessible for removal and a second position wherein the second removable component is not accessible for removal.

17. The band according to claim 11, wherein the portable memory device is selected from the group consisting of a Universal Serial Bus (USB) memory SD chip, wireless chip memory, bar code, and RF chip.

18. A band including information storage comprising:

an outer mold for attaching the band to a user;

a first removable component;

an external housing within the outer mold that includes a hollow upper portion for receiving the first removable component, wherein the first removable component is engraved with information about the user;

a second removable component; and an internal housing rotatably attached to the external housing and fitted therein for receiving the second removable component, wherein the second removable component includes a portable memory device, wherein at least one external face of the internal housing includes at least two nipples and an internal face of the external housing that is adjacent to the at least one external face of the internal housing includes at least two dimples for engaging the at least two nipples to hold the internal housing in a predetermined position.

* * * * *